US005149897A

United States Patent [19]

Howard

[11] Patent Number: 5,149,897

[45] Date of Patent: Sep. 22, 1992

[54] SEE-THROUGH MAGAZINE

[76] Inventor: William J. Howard, P.O. Box 573, Wilson, N.C. 27893

[21] Appl. No.: 802,831

[22] Filed: Dec. 6, 1991

[51] Int. Cl.[5] ..... F41A 9/62
[52] U.S. Cl. ..... 42/50
[58] Field of Search ..... 42/50

[56] References Cited

U.S. PATENT DOCUMENTS

| | | | |
|---|---|---|---|
| 3,465,463 | 9/1969 | Grandy | 42/50 |
| 3,758,978 | 9/1973 | Theodore | 42/50 |
| 4,107,862 | 8/1978 | Sofinowski, III | 42/50 |
| 4,109,401 | 8/1978 | Musgrave | 42/50 |
| 4,139,959 | 2/1979 | Howard et al. | 42/50 |
| 4,472,900 | 9/1984 | Howard | 42/50 |
| 4,888,900 | 12/1989 | Howard | 42/50 |
| 5,056,252 | 10/1991 | Velezis | 42/50 |

FOREIGN PATENT DOCUMENTS

| | | | |
|---|---|---|---|
| 875222 | 8/1961 | United Kingdom | 42/50 |

OTHER PUBLICATIONS

"Eaton" Advertisement; *Guns & Ammo;* p. 20, Jul. 1983.

"Eagle 10-Round Magazines"; *American Rifleman;* p. 58, Jun. 1985.

Exhibit A, undated advertisement for "AUG-SA" Rifle w. Transparent Magazine.

Exhibit B, Xerographic Picture of Transparent Magazine.

*Primary Examiner*—Charles T. Jordan
*Attorney, Agent, or Firm*—David R. Murphy

[57] ABSTRACT

A see-through magazine of a polyamide composition in which cartridges within the magazine are visible through the composition of the walls. The magazine holds and feeds cartridges to a bolt-equipped firearm. The magazine has a front wall, a back wall, and two sidewalls joining the front wall to the back wall. It also has a bottom plate closing the bottom of the magazine. A follower is spring-biased to move it away from the bottom plate. There are a number of integral translucent windows between internal ribs. Cartridges, when present can be seen through these windows.

7 Claims, 2 Drawing Sheets

FIG. 1
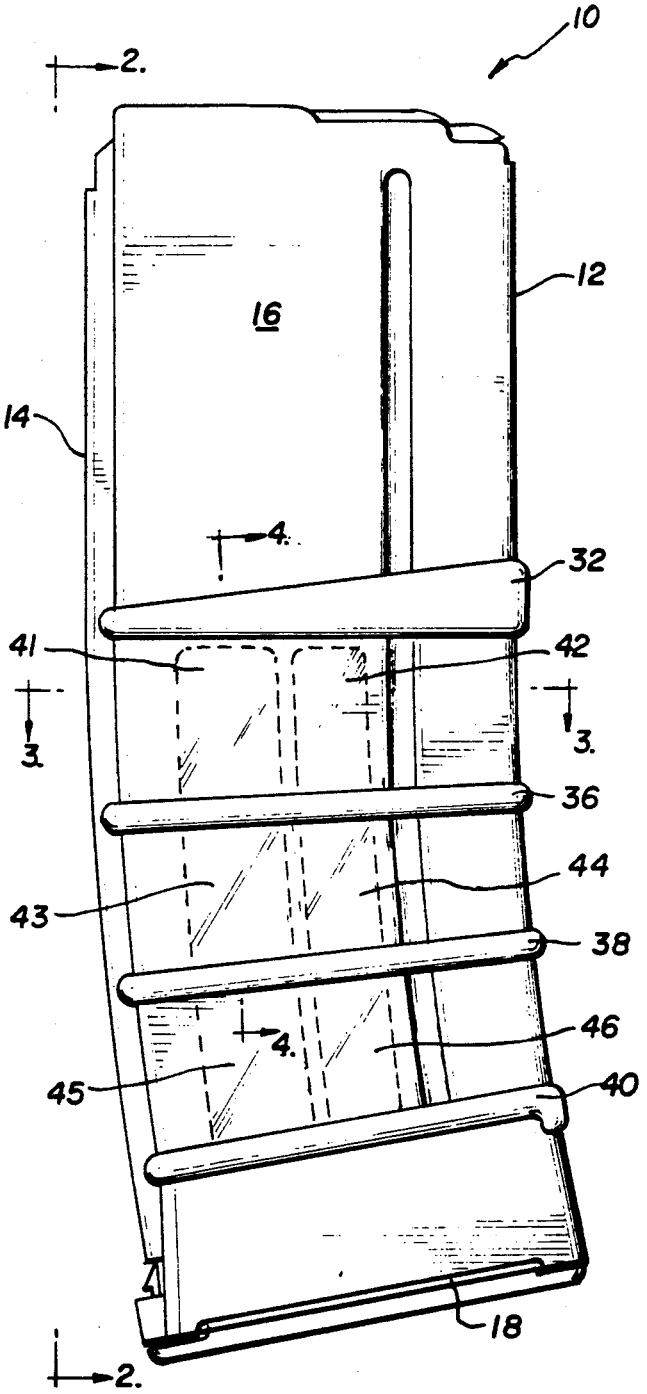
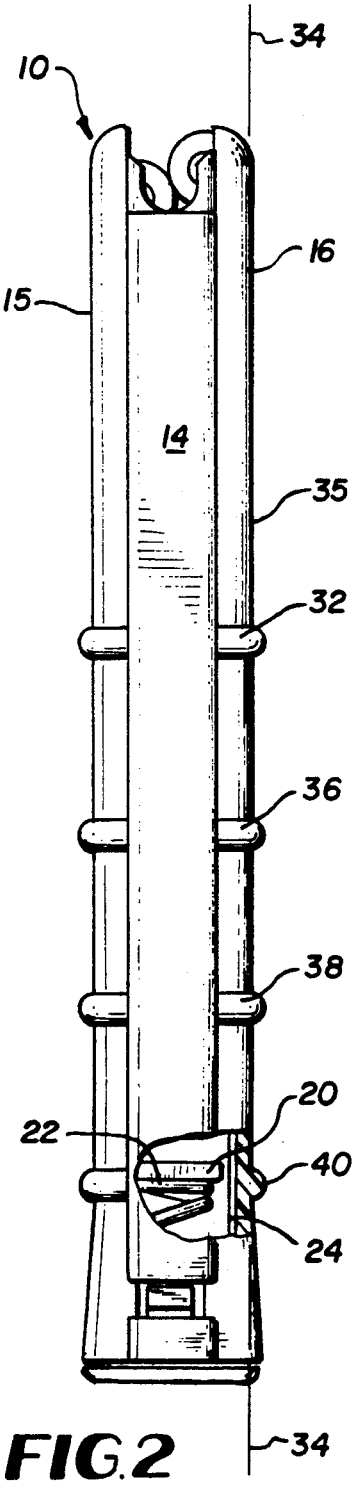
FIG. 2

FIG.3
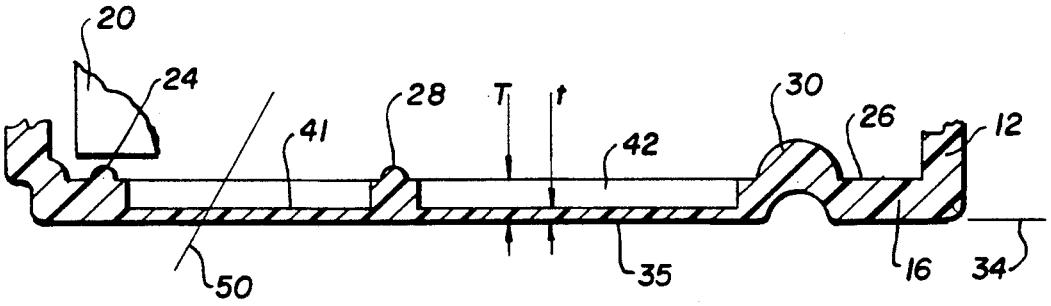
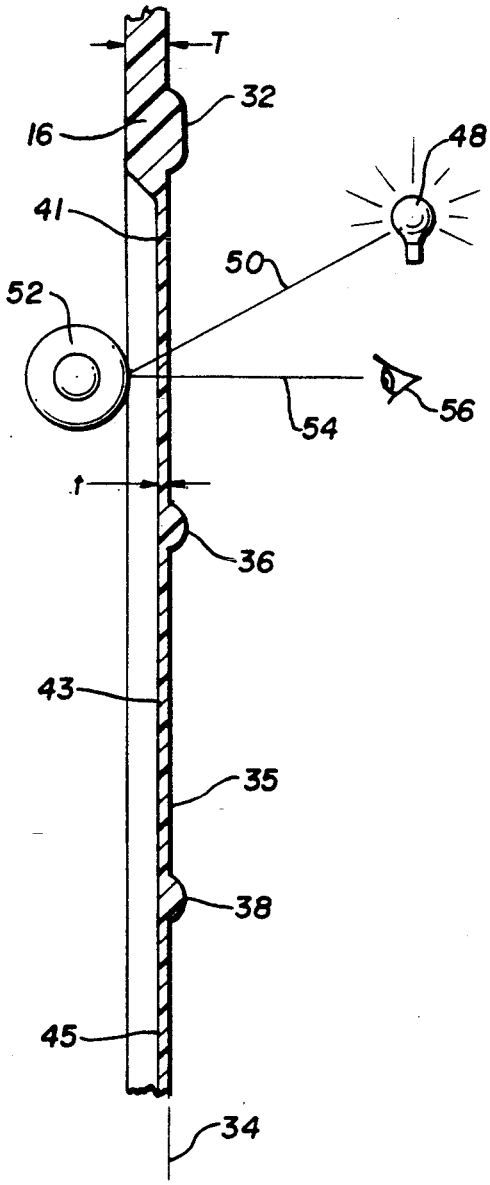
FIG.4

SEE-THROUGH MAGAZINE

Magazines are devices for holding and feeding cartridges to a bolt-equipped firearm. For many years these magazines were made of metal. However because of some of the adverse properties of metal such as its propensity to dent and to oxidize, there has been recent widespread acceptance of magazines of polyamide. See U.S. Pat. Nos. 4,472,900; 4,777,752 and 4,888,900 all naming William J. Howard as inventor. The preferred polyamide has come to be a composition of nylon 6–12, mixed with glass fibers and carbon black. Such compositions have the dark, non-light-reflecting surface demanded by hunters and by armed forces.

There has, however been a long-felt need to provide these polyamide magazines with a see-through feature such that it be possible to visually determine the number of cartridges in the magazine. Many people want to look at the outside of a magazine and determine whether it is full or empty. In sensitive geographic areas, particularly around nuclear reactors it is desired to provide guards with full magazines and then check at the end of their watch to determine that no cartridges have been fired. This is done by looking to see if the magazine is still full. In other situations it is desired to provide a group of soldiers with magazines that are empty and can be visually determined to be so.

There have been a great number of suggestions as to how to provide a see-through magazine. The most common suggestion is to use an organic plastic which is transparent. Musgrave employs an unspecified "clear plastic" in U.S. Pat. No. 4,109,401. One such transparent organic plastic is polymethylmethacrylate sold by the Dupont Company of Wilmington, Del., USA, under the tradename "LUCITE". Unfortunately polymethylmethacrylate has insufficient strength to be practical. Another such organic plastic is polycarbonate such as that sold by the General Electric Company of Schenectady, N.Y., USA, under the tradename "LEXAN". However polycarbonate is not useful since it has insufficient impact resistance.

Pure nylon 6–12 cannot be employed since it does not have sufficient strength unless mixed with glass fibers. Once mixed with glass fibers it is no longer sufficiently translucent to see cartridges through the walls of a typical magazine. If a composition of nylon 6–12 and glass fibers is further supplemented by the addition of carbon black, opacity further increases.

Another suggestion is to simply provide an opening in the form of a slot or hole in the magazine wall through which cartridges are visible. Such structure is disclosed in Grandy et al U.S. Pat. No. 3,465,463; Theodore U.S. Pat. No. 3,758,978 and Velezis U.S. Pat. No. 5,056,252. Such a solution undesirably permits dust, sand and grit to enter the magazine through this opening.

Still another suggestion is to provide a separate window of transparent material. However this solution requires an additional manufacturing step undesirably increasing the cost of the magazine. Furthermore the windows frequently break or become dislodged permitting sand and grit to enter the magazine.

Accordingly it is an object of the present invention to provide an improved see-through magazine substantially free of one or more of the disadvantages of prior see-through magazines.

Yet another object is to provide an improved see-through magazine which is free of unnecessary openings and is dust-tight.

Still another object is to provide an improved see-through magazine which can be manufactured with the industry acceptable composition of nylon 6–12.

Yet another object is to provide an improved see-through magazine which is inexpensive to manufacture.

Still another object is to provide an improved see-through magazine which does not require the use of a manufacturing step separate from the molding step.

Additional objects and advantages of the present invention will be apparent to those skilled in the art by reference to the following description and drawings wherein:

FIG. 1 is a side view of a magazine of the present invention; and

FIG. 2 is an end view taken along Line 2—2 of FIG. 1; and

FIG. 3 is a greatly enlarged sectional view taken along Line 3—3 of FIG. 1; and FIG. 4 is a greatly enlarged sectional view taken along Line 4—4 of FIG. 1.

The above and other objects are accomplished according to the present invention by providing a see-through magazine of a polyamide composition in which cartridges within the magazine are visible through the composition of the walls. This magazine is designed for holding, and reliably feeding cartridges to a bolt-equipped firearm. The magazine has a front wall; a back wall; and two sidewalls. The two sidewalls have a given thickness. They join the front wall to the back wall. The magazine also has a bottom plate closing the bottom of the magazine, as well as a follower, spring-biased by a spring to move the follower away from the bottom plate. Within the magazine are a plurality of longitudinal ribs on the inside surface of the side walls. These ribs guide the cartridges and the spring as they move up and down the magazine. The windows and the walls are of a composition of fiber-reinforced polyamide. The windows are thinner than the walls, and are translucent. Cartridges in the magazine can be seen through the windows.

In a preferred embodiment the plurality of integral translucent windows are of a composition which is opaque when it is as thick as the thickness of the walls, but is translucent when of a thickness of the windows. The windows preferably have a thickness less than one fifth that of the walls. Finally the outside surface of all windows lies in the plane of the outside wall.

A wide variety of polyamides can be employed in compositions useful in the present invention such as those derived from polycarboxylic acids and polyamines, preferably dicarboxylic acids and diamines. Polyamides derived from amino acids such as caprolactam are also suitable. The preferred polyamide is nylon, in general and nylon 6–12 in particular.

The composition must be fiber-reinforced. A wide variety of fibers can be employed including those of carbon, graphite, mineral and asbestos. However the preferred fibers are those of glass. Glass fibers are preferred because of cost, availability, tensile strength, bending strength and the fact that they are translucent. Fibers should be added to the composition in that amount barely necessary to impart to the composition sufficient tensile strength, compressive strength and impact resistance.

Carbon black and/or other fillers need not be present. However when present they must be less than that amount which renders the composition of the thickness of the windows, opaque. When carbon black is present, it should comprise less than forty weight percent of the composition.

The magazine of the present invention is preferably formed of a composition comprising, and preferably consisting essentially of about twenty to sixty percent by weight of glass fibers; less than thirty percent by weight carbon black; balance essentially 6–12 nylon wherein all percentages are based on the total weight of the composition.

Referring now to the drawings in general and FIGS. 1 and 2 in particular there is shown a polyamide, see-through, dust-tight, magazine 10 of the present invention. The magazine 10 has a front wall 12 of a given thickness; a back wall 14 of about the same given thickness and two sidewalls 15, 16 of generally about the same given thickness. The sidewalls 15, 16 join the front wall 12 to the back wall 14. The bottom of the magazine 10 is closed by a bottom plate 18. A follower 20 is spring-biased by a spring 22 to move the follower 20 upwardly away from the bottom plate 18.

Referring now to FIG. 3 there is shown a first longitudinal rib 24 on the inside surface 26 of the right side wall 16. The rib 24 guides the rear portion of the cartridges as they move longitudinally up and down within the magazine 10. A second longitudinal rib 28 also on the inside surface 26 of the side wall 16 guides the spring 22 as it moves longitudinally up and down the magazine 10. A third longitudinal rib 30 also on the inside surface 26 of the right side wall 16 guides the cartridges as they move longitudinally up and down the magazine 10. The left side wall 15 is provided with identical longitudinal ribs (not shown) which are the mirror images of the longitudinal ribs 24, 28, 30.

Referring now to FIG. 4 it can bee seen that the magazine 10 has a stop rib 32 on the outside of the right sidewall 16. The stop rib 32 extends outwardly from the plane 34 of the exterior surface 35 of the sidewall 16. The stop rib 32 is adapted to stop upward movement of the magazine 10 when the magazine 10 is inserted into the firearm (not shown). The magazine 10 also has a first transverse rib 36 on the outside of the side wall 16. The rib 36 also extends outwardly from the plane 34 of the sidewall 16. The rib 36 is below the stop rib 32, parallel to it, and spaced a distance from it. The magazine 10 also has a second transverse rib 38 on the outside of the right side wall 16 extending outwardly from the plane 34 of the sidewall 16, below the first transverse rib 36, parallel to it, and spaced a distance from it. A third transverse rib 40 (See FIG. 2) is on the outside of the right side wall 16 extending outward from the plane 34 of the sidewall 16, below the second transverse rib 38, parallel to it, and spaced a distance from it.

The magazine 10 is provided with six translucent windows, 41, 42, 43, 44, 45, and 46. The first translucent window 41 is representative. The window 41 is in a rectangle bounded by the stop rib 32, the rear longitudinal rib 24, the first transverse rib 36, and the middle longitudinal rib 28.

The second translucent window 42 is in the rectangle bounded by the stop rib 32, the middle longitudinal rib 28, the first transverse rib 36, and the forward longitudinal rib 30.

The third translucent window 43 is in the rectangle bounded by the first transverse rib 36, the rear longitudinal rib 24, the second transverse rib 38, and the middle longitudinal rib 28.

The fourth translucent window 44 is in the rectangle bounded by the first longitudinal rib 36, the middle longitudinal rib 28, the second transverse rib 38, and the forward longitudinal rib 30.

The fifth translucent window 45 is in the rectangle bounded by the second transverse rib 38, the rear longitudinal rib 24, the third transverse rib 40, and the middle longitudinal rib 28.

The sixth translucent window 46 is in the rectangle bounded by the second transverse rib 38, the middle longitudinal rib 28, the third transverse rib 40, and the forward longitudinal rib 30. The left side wall 15 has similar windows (not shown).

All windows including the windows 41, 42, 43, 44, 45, 46 are integrally formed of the same composition as the walls 12, 14, 15, 16.

The windows 41, 42 have a thickness "t" less than one fifth the thickness "T" of the right side wall 16. The thickness of all other windows has a similar relationship. Because the windows are so thin they are translucent. As shown in FIG. 4, light from a source 48 emits a beam 50 of light which passes through the window 41. This beam 50 reflects off the cartridge 52 as reflected beam 54. The reflected beam 54 is detected by the observers eye 56. A typical figure for wall thickness "T" is 1.5 to 2.5 mm for example 0.060 inch whereas a typical figure for window thickness is 0.1 to 0.5 mm for example 0.025 inch.

It will be readily apparent that the magazine 10 is dust-tight in the same manner as similar prior magazines. Windows have been added without providing an additional point of ingress for dust, sand and grit. Because the magazines of the present invention have an integral window, no separate manufacturing step is required. Because the windows lie in the plane of the outside wall, there are no projections or protuberances to catch. Furthermore since the outside dimensions of the magazine have not changed, compared to the prior art, all prior art handling and storage devices can be employed. Finally these improved magazines can be made of a carbon-black-containing composition to reduce light reflection.

Although the invention has been described in considerable detail with reference to a preferred embodiment thereof, it will be understood that changes and modifications can be made without departing from the scope of the invention as described above and as defined in the following claims.

What is claimed is:

1. A see-through magazine of a polyamide composition in which cartridges within the magazine are visible, said magazine being for holding, and reliably feeding cartridges to a bolt-equipped firearm; said magazine comprising:

a front wall; and a back wall; and two sidewalls of a given thickness joining the front wall to the back wall; and a bottom plate closing the bottom of the magazine; and a follower spring-biased, by a spring to move away from the bottom plate; and a plurality of longitudinal ribs on the inside surface of the side walls, wherein said ribs guide the spring and the cartridges as they move up and down the magazine; and a plurality of integral translucent windows between the longitudinal ribs; and wherein the windows and the walls are of a composition of fiber-reinforced polyamide; and wherein the windows are thinner than the walls, are translucent, and wherein cartridges in the magazine can be seen through the windows.

2. The magazine of claim 1 wherein all windows are integrally formed of the same composition as the walls of the magazine.

3. The magazine of claim 1 wherein the polyamide is nylon.

4. The magazine of claim 1 wherein the fibers of the fiber reinforced polyamide are glass fibers.

5. The magazine of claim 1 wherein the composition consists essentially of about twenty to sixty percent by weight of glass fibers, less than thirty percent by weight carbon black, balance essentially nylon 6–12 wherein all percentages are based on the total weight of the composition.

6. A see-through magazine of an polyamide composition in which cartridges within the magazine are visible, said magazine being for holding, and reliably feeding cartridges to a bolt-equipped firearm; said magazine comprising:

a front wall; and a back wall; and two sidewalls of a given thickness joining the front wall to the back wall; and a bottom plate closing the bottom of the magazine; and a follower spring biased to move away from the bottom plate; and a plurality of longitudinal ribs on the inside surface of the side walls, wherein said ribs guide the cartridges and the spring as they move up and down the magazine; and a lateral stop rib adapted to stop upward movement of the magazine when the magazine is inserted into the firearm; and a plurality of transverse ribs on the outside of the side walls below the stop rib, parallel thereto, and spaced a distance therefrom; and a plurality of integral translucent windows between the ribs; and wherein the composition is opaque when of a thickness of the walls, but is translucent when of a thickness of the windows; and wherein the windows have a thickness about one third that of the walls; and wherein the outside surface of all windows lies in that plane of the exterior surface of the outside wall.

7. A polyamide, see-through, dust-tight, magazine in which cartridges within the magazine are visible, said magazine being for holding, and reliably feeding cartridges to a bolt-equipped firearm; said magazine comprising:

a front wall of a given thickness; and a back wall of about the same given thickness; and two sidewalls of generally about the same given thickness joining the front wall to the back wall; and a bottom plate closing the bottom of the magazine; and a follower spring-biased by a spring to move the follower upwardly away from the bottom plate; and a first longitudinal rib on the inside surface of the side wall, wherein said first longitudinal rib guides the rear portion of the cartridges as they move longitudinally up and down the magazine; and a second longitudinal rib on the inside surface of the side wall, wherein said second longitudinal rib guides the spring as it moves longitudinally up and down the magazine; and a third longitudinal rib on the inside surface of the side wall, wherein said third longitudinal rib guides the forward portion of the cartridges as they move longitudinally up and down the magazine; and a stop rib on the outside of the sidewall extending outward from the plane of the sidewall wherein said stop rib is adapted to stop upward movement of the magazine when the magazine is inserted into the firearm; and a first transverse rib on the outside of the side wall extending outward from the plane of the sidewall, below the stop rib, parallel thereto, and spaced a distance therefrom; and a second transverse rib on the outside of the side wall extending outward from the plane of the sidewall, below the first transverse rib, parallel thereto, and spaced a distance therefrom; and a third transverse rib on the outside of the side wall extending outward from the plane of the sidewall, below the second transverse rib, parallel thereto, and spaced a distance therefrom; and a first translucent window in a rectangle bounded by the stop rib, the first longitudinal rib, the first transverse rib, and the second longitudinal rib; and a second translucent window in the rectangle bounded by the stop rib, the second longitudinal rib, the first transverse rib, and the third longitudinal rib; and a third translucent window in the rectangle bounded by the first transverse rib, the first longitudinal rib, the second transverse rib, and the second longitudinal rib; and a fourth translucent window in the rectangle bounded by the first transverse rib, the second longitudinal rib, the second transverse rib, and the third longitudinal rib; and a fifth translucent window in the rectangle bounded by the second transverse rib, the first longitudinal rib, the third transverse rib, and the second longitudinal rib; and a sixth translucent window in the rectangle bounded by the second transverse rib, the second longitudinal rib, the third transverse rib, and the third longitudinal rib; and wherein all windows are integrally formed of the same composition as the walls of the magazine; and wherein the composition is translucent; and wherein the composition consists essentially of about twenty to sixty percent by weight of glass fibers, less than about thirty percent by weight carbon black, balance essentially nylon 6–12 wherein all percentages are based on the total weight of the compositions; and wherein the windows have a thickness about one third that of the walls; and wherein the outside surface of all windows lies in the plane of the exterior surface of the outside wall; and wherein cartridges in the magazine below the stop rib and above the third transverse rib are visible through one or more of the windows.

* * * * *